US006922121B2

(12) United States Patent
Kim

(10) Patent No.: US 6,922,121 B2
(45) Date of Patent: Jul. 26, 2005

(54) POWER SAVING ELECTROMAGNETIC SWITCH

(76) Inventor: Yong Hak Kim, 1166-2 Singil-dong, Yeongdeungpo-gu, Seoul (KR)

( * ) Notice: Subject to any disclaimer, the term of this patent is extended or adjusted under 35 U.S.C. 154(b) by 0 days.

(21) Appl. No.: 10/963,070

(22) Filed: Oct. 11, 2004

(65) Prior Publication Data

US 2005/0104695 A1 May 19, 2005

(30) Foreign Application Priority Data

Oct. 22, 2003 (KR) ..... 10-2003-0073714

(51) Int. Cl.[7] ..... H01F 7/08; H01H 9/20
(52) U.S. Cl. ..... 335/167; 335/132; 335/253
(58) Field of Search ..... 335/113, 127–132, 335/167–171

(56) References Cited

U.S. PATENT DOCUMENTS 3,346,827 A * 10/1967 Baker et al. ..... 335/253
4,078,709 A * 3/1978 Jenkins ..... 226/180
6,229,421 B1 * 5/2001 Floyd et al. ..... 335/253

FOREIGN PATENT DOCUMENTS

JP 57-025524 10/1982 ..... F16D/27/10

* cited by examiner

*Primary Examiner*—Ramon M. Barrera
(74) *Attorney, Agent, or Firm*—Brown Rudnick Berlack Israels LLP; Brian L. Michaelis, Esq.

(57) ABSTRACT

A power saving electromagnetic switch, which is developed to reduce power consumption and implemented using low trouble mechanical parts compared to a conventional electromagnetic switch in which a fixed iron core is electrified to fasten a movable iron core and then a continuous current passes through the fixed iron core during the operation thereof. The power saving electromagnetic switch includes a fixed iron core, a movable iron core and a fastening bar. The fixed iron core includes a guide hole vertically formed from a top thereof, and a through hole formed to penetrate through a side of the fixed iron core and to communicate with the guide hole. The movable iron core moves upward or downward to come into contact with the top of the fixed iron core, and includes a guide rod mounted on a bottom thereof so as to be inserted into the guide hole, the guide rod having a fastening hole formed at an end thereof. The fastening bar is inserted into the fastening hole through the through hole when a bottom of the movable iron core comes into contact with the top of the fixed iron core.

3 Claims, 4 Drawing Sheets

POWER SAVING ELECTROMAGNETIC SWITCH

CROSS REFERENCED TO RELATED APPLICATIONS

This application claims priority from Korean Patent Application No. 10-2003-0073714, filed on Oct. 22, 2003 the contents of which are incorporated herein by reference in its entirety.

FIELD OF THE INVENTION

The present invention relates, in general, to power saving electromagnetic switches and, more particularly, to a power saving electromagnetic switch, which is developed to reduce power consumption and implemented using low trouble mechanical parts compared to a conventional electromagnetic switch in which a fixed iron core is electrified to fasten a movable iron core and then a continuous current passes through the fixed iron core during the operation thereof.

BACKGROUND OF THE INVENTION

Description of the Related Art

Generally, electromagnetic switches are devices for electrically controlling the flow of electricity, and have been widely used for various electrical products in industrial appliances, such as various automatic instruments.

FIG. 4 is conceptual view showing the principles of a conventional electromagnetic switch. The electromagnetic switch includes a fixed iron core 1 that is electrified by a switch 51 to be converted into a electromagnet 1, a movable iron core 2 that moves upward or downward to come into contact with the top of the fixed iron core 1, and at least one portion 6 that transmits or cuts off electricity between both side contact points in conjunction with the movable iron core 2.

That is, the electromagnetic switch is operated so that, if the switch 51 is operated, an electric current flows through an electromagnetic coil 5 and the electromagnetic coil 5 is converted into an electromagnet, so that the movable iron core 2 is attracted to connect both side contact points to each other, thus electrifying the contact points.

Therefore, various dangerous accidents, occurring when a user operates a switch having portions through which high voltage electricity flows and which are directly connected to each other, can be prevented.

However, the conventional electromagnetic switch is problematic in that, when it is operated, the electromagnetic coil 5 of the fixed iron core 1 must always be kept electrified, thus increasing power consumption, and causing malfunction due to defects or deterioration of electric devices.

SUMMARY OF THE INVENTION

Accordingly, the present invention has been made keeping in mind the above problems occurring in the prior art, and an object of the present invention is to provide a power saving electromagnetic switch, which does not electrify a circuit connected to an electromagnetic coil during the operation of the electromagnetic switch.

In order to accomplish the above object, the present invention provides a power saving electromagnetic switch, comprising a fixed iron core including a guide hole vertically formed from a top thereof, and a through hole formed to penetrate through a side of the fixed iron core and to communicate with the guide hole; a movable iron core moving upward or downward to come into contact with the top of the fixed iron core, the movable iron core including a guide rod mounted on a bottom thereof so as to be inserted into the guide hole, the guide rod having a fastening hole formed at an end thereof; and a fastening bar inserted into the fastening hole through the through hole when a bottom of the movable iron core comes into contact with the top of the fixed iron core.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Hereinafter, embodiments of the present invention will be described in detail with reference to the attached drawings.

Figure 1:
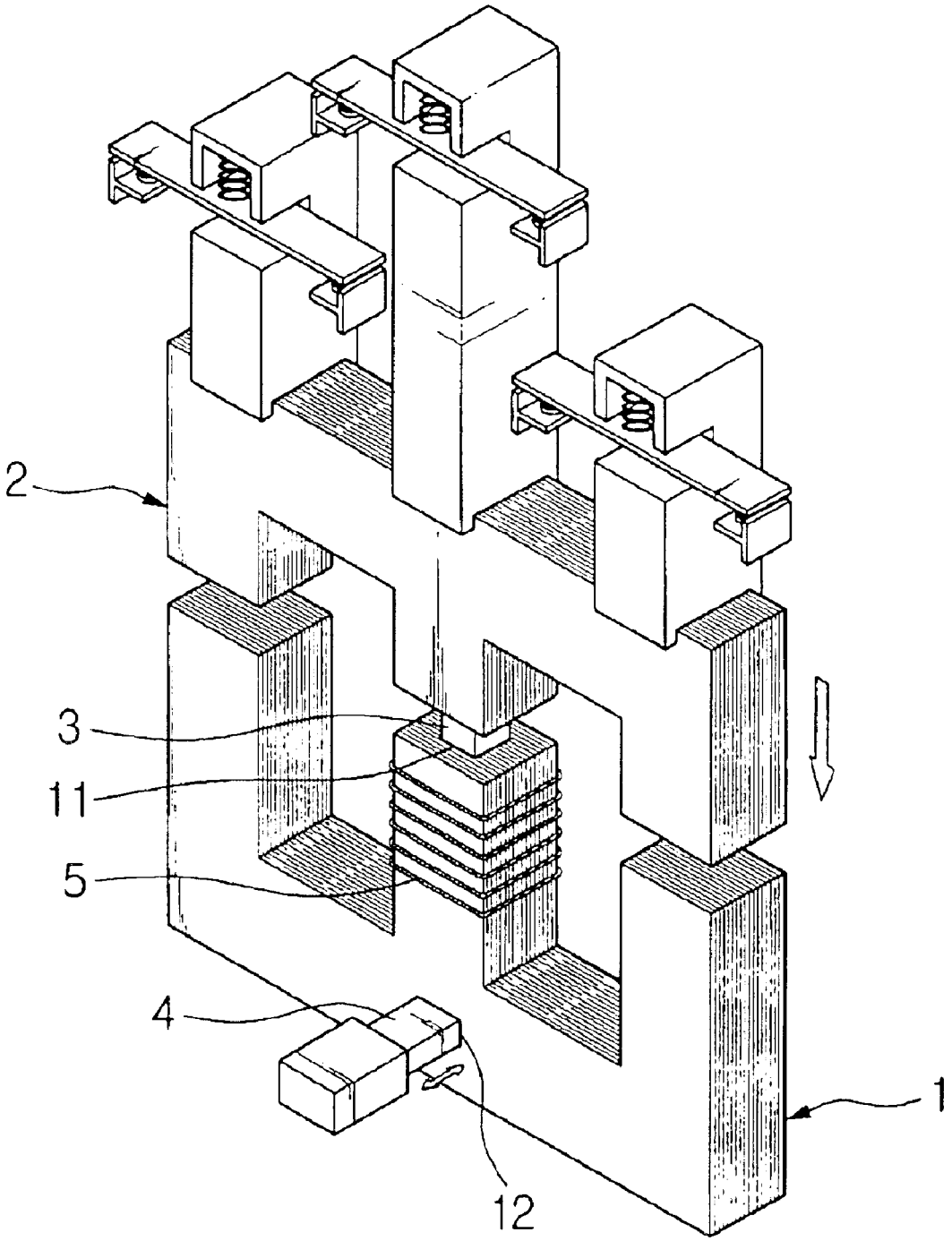
FIG. 1 is a conceptual view of an electromagnetic switch according to an embodiment of the present invention.
Figure 2:
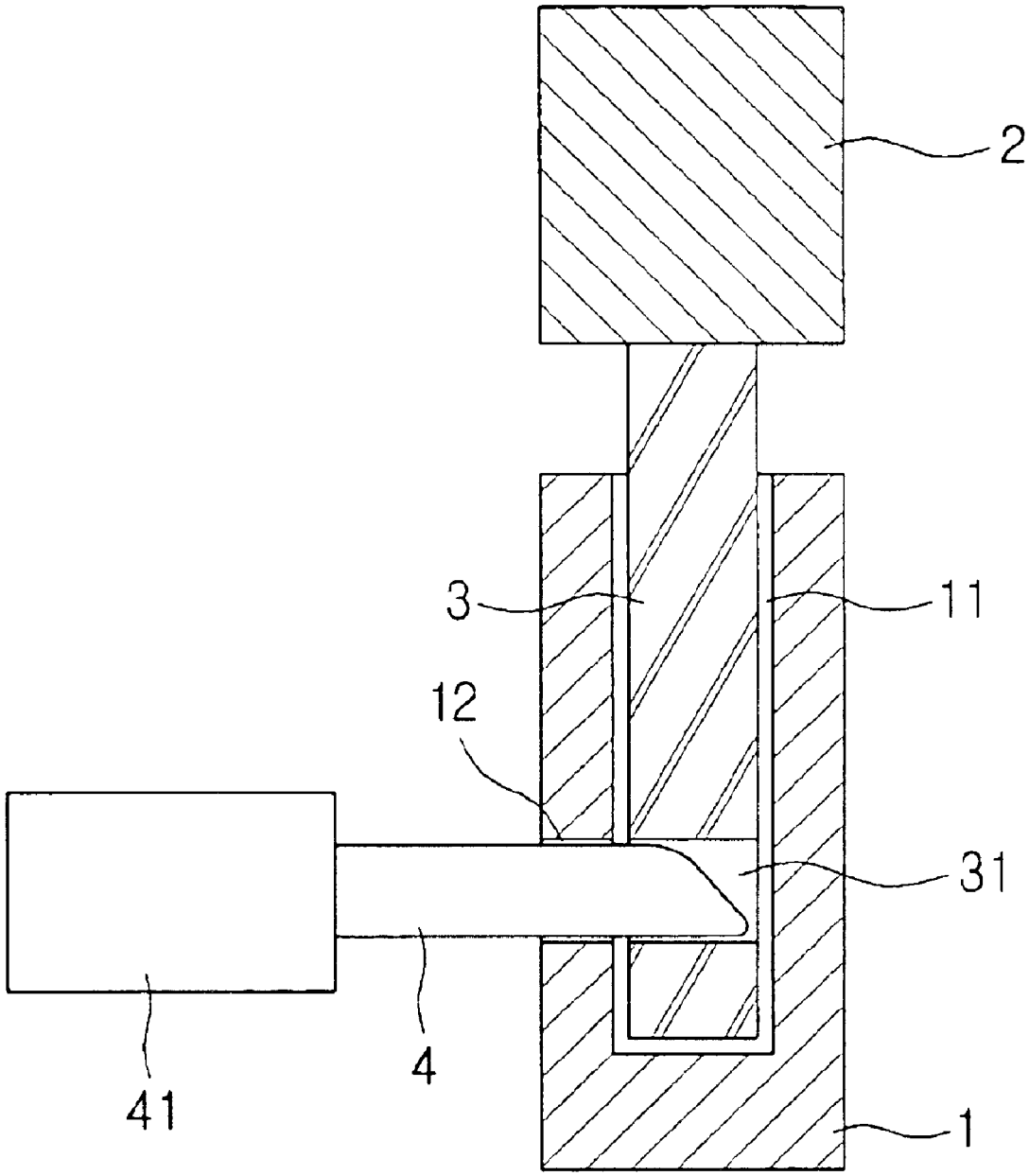
FIG. 2 is a sectional view of the electromagnetic switch according to the embodiment of the present invention.

Reference now should be made to the drawings, in which the same reference numerals are used throughout the different drawings to designate the same or similar components. FIG. 1 is a conceptual view of an electromagnetic switch according to an embodiment of the present invention, and FIG. 2 is a sectional view of the electromagnetic switch according to the embodiment of the present invention. Referring to FIGS. 1 and 2, the electromagnetic switch includes a fixed iron core 1 and a movable iron core 2 that moves upward or downward to come into contact with the top of the fixed iron core 1.

In the fixed iron core 1, a guide hole 11 is vertically formed from the top of the iron core 1, and a through hole 12 is formed to penetrate through a side of the iron core 1 and to communicate with the guide hole 11. A guide rod 3 is mounted on the bottom of the movable iron core 2 so as to be inserted into the guide hole 11, and provided with a fastening hole 31 formed at the end of the guide rod 3. A fastening bar 4 is inserted into the fastening hole 31 through the through hole 12 when the bottom of the movable iron core 2 comes into contact with the top of the fixed iron core 1.

Therefore, when the electromagnetic coil 5 is electrified and converted into an electromagnet, the movable iron core 2 is attracted, so that the guide rod 3 is attracted into the guide hole 11, and the movable iron core 2 is fastened into the fastening hole 31 formed in the inserted guide rod 3 by the fastening bar 4 equipped with an elastic unit.

That is, the electromagnetic switch is manufactured in the form of a button or time switch to be able to maintain its continuously operating status using only momentary contact of the fastening bar without continuously electrifying the electromagnetic coil 5 to maintain the operating status of the switch as in the case of the conventional switch.

Further, in order to discontinue such operating status, if the fastening bar 4 is horizontally retracted by a solenoid 41, the movable iron core 2 and the guide rod 3 are moved upward, thus stopping the operation.

Further, according to the type of conventional switch, there may occur a case where the electromagnetic coil 5 is electrified using separate power and converted into an electromagnet, and the electromagnet is continuously electrified during an operating time, thus reducing the lifespan of the conventional switch, and requiring frequent replacement of a battery. However, according to the present invention, the lifespan of a battery is increased several tens of times, thus reducing the maintenance cost and replacement cost.

Further, one end of the fastening bar 4 preferably has an inclined surface, so that the fastening bar 4 can be easily retracted a certain length by the pressure of the descending guide rod 3.

Figure 3:
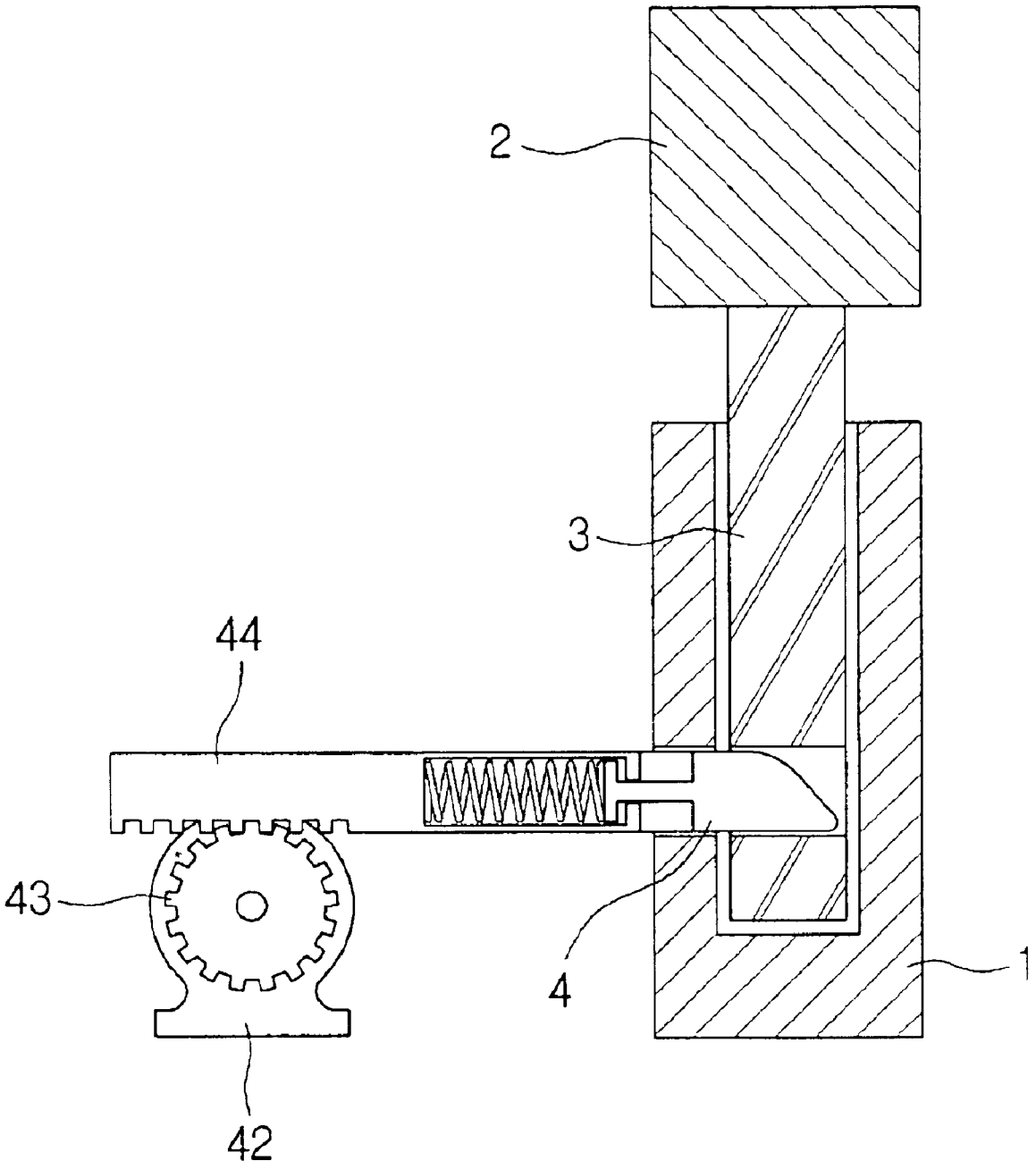
FIG. 3 is a sectional view of an electromagnetic switch according to another embodiment of the present invention.
Figure 4:
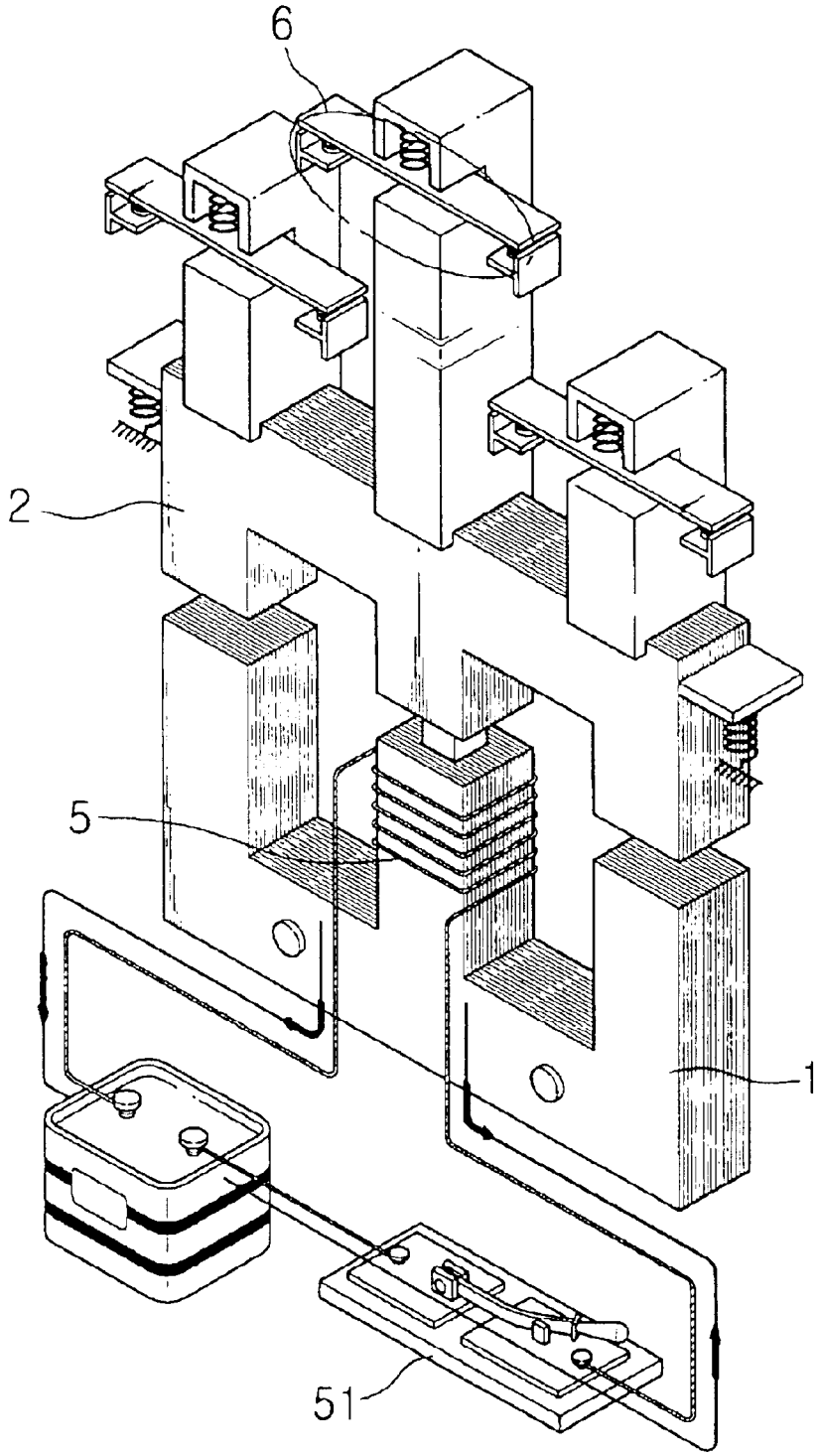
FIG. 4 is a conceptual view showing the construction of a conventional power saving electromagnetic switch.

FIG. 3 is a sectional view of an electromagnetic switch according to another embodiment of the present invention, and illustrates an embodiment in which the fastening bar 4 horizontally moves by a motor 42. In particular, a pinion 43 is mounted on the shaft of the motor 42 and the fastening bar 4 is projected or retracted by a rack 44 corresponding to the pinion 43.

Further, those skilled in the art can easily design several embodiments through the use of a scheme using a combination of a screw and a threaded part, a scheme using a linkage composed of a plurality of links, etc., in addition to the embodiment using a combination of the rack and the pinion. Further, a method of manually operating the switch can also be used without using the solenoid or the motor.

For example, the construction of the present invention can be applied to a magnetic switch, including a fixed iron core 1 and a movable iron core 2 moving upward or downward to come into contact with the top of the fixed iron core 1, without change, and the power saving magnetic switch can be implemented so that a guide hole 11 is vertically formed from the top of the iron core 1 and a through hole 12 is formed to penetrate through a side of the iron core 1 and to communicate with the guide hole 11 in the fixed iron core 1, a guide rod 3 is mounted on the bottom of the movable iron core 2 so as to be inserted into the guide hole 11 and has a fastening hole 31 formed at the end of the guide rod 3, and a fastening bar 4 is inserted into the fastening hole 31 through the through hole 12 when the bottom of the movable iron core 2 comes into contact with the top of the fixed iron core 1.

As described above, the present invention provides a power saving electromagnetic switch, which can prevent electricity from continuously flowing through an electromagnetic coil during the operation of the power saving electromagnetic switch, and maintain its operating status through the mechanical construction of the switch, thus reducing power consumption and increasing the durability of the switch.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A power saving electromagnetic switch, comprising:

a fixed iron core including a guide hole vertically formed from a top thereof, and a through hole formed to penetrate through a side of the fixed iron core and to communicate with the guide hole;

a movable iron core moving upward or downward to come into contact with the top of the fixed iron core, the movable iron core including a guide rod mounted on a bottom thereof so as to be inserted into the guide hole, the guide rod having a fastening hole formed at an end thereof; and a fastening bar inserted into the fastening hole through the through hole when a bottom of the movable iron core comes into contact with the top of the fixed iron core.

2. The power saving electromagnetic switch according to claim 1, wherein the fastening bar is horizontally moved by a solenoid.

3. The power saving electromagnetic switch according to claim 1, wherein the fastening bar is horizontally moved by a motor.

* * * * *